United States Patent [19]

Smith et al.

[11] Patent Number: 4,494,198

[45] Date of Patent: Jan. 15, 1985

[54] GUN FIRE CONTROL SYSTEMS

[75] Inventors: Gordon R. Smith; John H. Stewart, both of Glasgow; Ralph H. Bagnall-Wild, Helensburgh, all of Scotland

[73] Assignee: Barr & Stroud Limited, Glasgow, Scotland

[21] Appl. No.: 352,696

[22] Filed: Feb. 26, 1982

[30] Foreign Application Priority Data

Mar. 12, 1981 [GB] United Kingdom ..... 8107756

[51] Int. Cl.[3] ..... G06F 15/58; G06G 7/80

[52] U.S. Cl. ..... 364/423; 235/414; 235/404

[58] Field of Search ..... 364/423, 516, 571; 235/400, 404, 407, 410, 414, 416, 412, 411; 89/41 D, 41 R, 127, 41 EA, 41 AA, 41 ME

[56] References Cited

U.S. PATENT DOCUMENTS

| | | | |
|---|---|---|---|
| 3,575,085 | 4/1971 | McAdam, Jr. | 235/404 |
| 3,604.897 | 9/1971 | McAdam, Jr. | 89/41 AA |
| 4,402,250 | 9/1983 | Baasch | 364/423 |

*Primary Examiner*—James D. Thomas
*Assistant Examiner*—Dale M. Shaw
*Attorney, Agent, or Firm*—Mason, Fenwick & Lawrence

[57] ABSTRACT

A gun fire control system comprises a computer (15) having a first memory (15A) preprogrammed with true range to standard ballistic range conversion data and is operable on receipt of a true range value from a rangefinder (16) to output the corresponding standard ballistic range value. A second memory (15B) of the computer (15) is preprogrammed with correction coefficients (A,B,M,N) arranged in sets pertaining to different types of ammunition one set being operable according to the position of a selector switch (13) and being delivered to a calculator (15C) together with an operator correction value (COR) (from buttons 14A, 14B) which is a judgment on the magnitude and direction by which a projectile misses a target sighted according to the range value presented at display (11). Calculator (15C) operates according to a predetermined algorithm to establish parameter correction changes (ΔAD, ΔCT) and delivers these changes to calculator/store (15D) which updates and stores parameter values (AD, CT). An arithmetic unit (15F) evaluates a range correction factor from the data available from memory (15B) and unit (15D) at the ballistic range established by memory (15A). This range correction factor is combined with the ballistic range established by memory (15A) in unit (15G) and the corrected ballistic range made visibly available in display (11) to the operator. To establish initial values of the parameters (AD, CT) for use in a system restart mode when elapsed time between consecutive operations of the rangefinder (16) exceeds a preset value high and low operator correction averages (HCOR, LCOR) are evaluated on each operation of the system and stored in memory (15E).

7 Claims, 2 Drawing Figures

GUN FIRE CONTROL SYSTEMS

Figure 1:
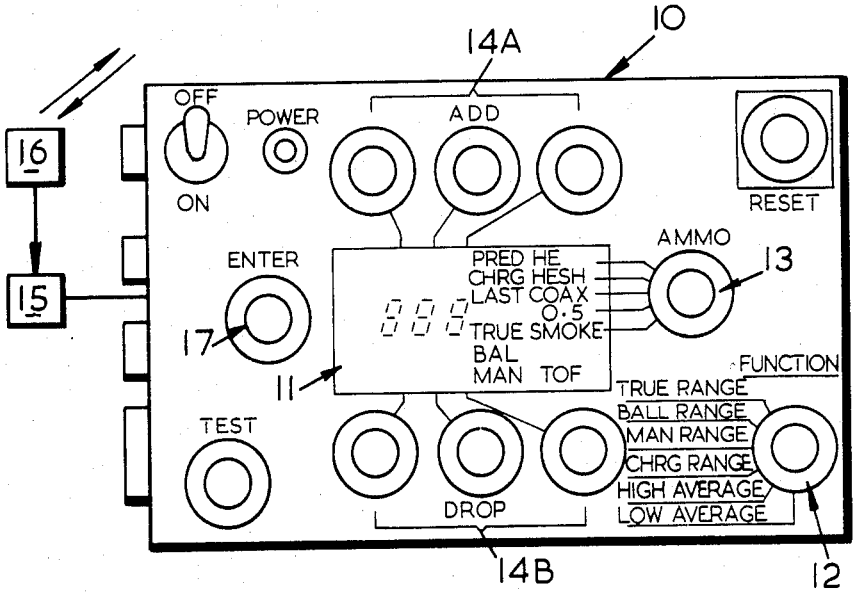

This invention relates to gun fire control systems.

Known gun fire control systems incorporate a rangefinder for assessing target range and a gun sight for viewing the field of view in which the target is located. The gun sight incorporates a computer controlled aiming mark or a graticule calibrated with range markings specific to a particular form of ammunition and relative to the gun barrel axis. The graticule calibrations, being non-adjustable, are correct only for a particular set of gun-barrel parameters (gun barrel wear and bending) and atmospheric parameters (such as temperature, pressure and humidity). Unfortunately these parameters are not constant and, if a hit is to be achieved on the target, it becomes necessary to depart from the specific graticule range marking relevant to the measured target range by an amount dependent upon the cumulative variation in the aforesaid parameters. Traditionally this departure has been assessed on a trial and error basis by the gunner firing one or more preliminary shots but, more recently, the fire control system has incorporated a computer receiving input signals from parameter sensors and outputting an aiming mark to the sight graticule. This computer requires to be fairly powerful since the conventional ballistic equations which it utilises are relatively complicated and the atmospheric parameters referred to are determined by environmental sensors which, in the case of tanks and the like, are external to the armour plating. Such external environmental sensors have a disadvantage when under attack (since enemy ammunition may penetrate the armour plating at the site of the environmental sensors and/or disable these sensors). A further disadvantage of the known systems is that whereas it is a simple matter for the gunner to change the type of ammunition in use the sight graticule cannot be readily changed and consequently the effectiveness of the systems becomes reliant solely upon the computer generated aiming mark, and the need to programme the computer with data relevant to each possible type of ammunition further emphasises the requirement for a powerful computer.

Recently there has been introduced a gun fire control system comprising a sight graticule with a standard ballistic scale relating range with gun elevation and a computer arranged to correlate true target range with the ballistic scale range for each of a plurality of different types of ammunition, the computer being operable on receipt of a true range value to establish and display a range value on the ballistic scale effective to provide the gun elevation required for a selected type of ammunition. The computer is preprogrammed and permits the gunner to change the type of ammunition in use and be provided by the fire control system with a displayed range value which, if the same graticule range value is superimposed on the target, will result in a target hit provided the gun barrel parameters and the atmospheric parameters are at their set values. If these parameters have departed from their set values the gunner can utilise the traditional procedure for assessing and correcting for the departure.

In order to correlate the true range value input with the ballistic range value output it has been proposed that the computer be provided with a plurality of first sections respectively correlating true range with gun elevation for each of a plurality of different types of ammunition, a second section correlating gun elevation with range on the standard ballistic scale, and a selector for selecting one of said first sections, the true range input value being used as an address to locate a gun elevation value in the selected first section and the located gun elevation value being used as an address to locate the range value on the ballistic scale which is displayed. Alternatively, it has been proposed that the computer be provided with a single section incorporating a plurality of coefficients, a set of such coefficients being obtained from a look-up table in the computer whose address is determined by ammunition type and true range so that the computer converts directly from true range to ballistic range.

The standard ballistic scale may in fact be identical to that correlating true range with gun elevation for a particular type of ammunition but this need not be the case.

The present invention provides an improved gun fire control system wherein dependence upon environmental sensors is reduced.

According to the present invention there is provided a gun fire control system comprising a computer having a first memory preprogrammed with true range to standard ballistic range conversion data and operable on receipt of a true range value to output the corresponding standard ballistic range value from said conversion data, a second memory preprogrammed with correction coefficients, calculating means for evaluating air density and charge temperature parameters responsive to a manual range-correction input by a system operator, means for evaluating a correction factor utilising the parameter values output by said calculating means, said standard ballistic range value and the correction coefficients stored in said second memory, and means for combining the standard ballistic range value and the correction factor to provide a corrected ballistic range value.

The standard ballistic range conversion data with which the first memory is preprogrammed may be identical to that correlating true range with gun elevation for a particular type of ammunition but this need not be the case as has been explained.

Preferably said calculating means is operational to evaluate increments in said parameters utilising the same algorithm as the correction factor evaluating means based upon said manual range-correction input at a particular true range value and zero correction factor at a predetermined true range value. Conveniently said predetermined true range value is either a minimum or maximum range value, the selection being according to which is more remote from said particular true range value.

The system may have a sight incorporating a graticule whose range markings correspond with those of the standard used in the conversion data in which case the corrected ballistic range value provided by the determining means may be displayed visually in numeric form as a command signal to the operator so that he can thereafter superimpose the corresponding graticule marking on the target. Alternatively the sight may incorporate a computer-controlled aiming mark, for example an ellipse, the position of which in the sight is determined by the corrected ballistic range value provided by the determining means and which is effective as a command signal to the operator so that he can thereafter superimpose the aiming mark on the target. As is already known the size of the aiming mark may also be made inversely proportional to target range. It will be evident that the prior art discloses that the operators command signal may be either in the form of an aiming mark or a range value and that the present invention which is concerned with the achievement of such a command signal in the absence of environmental sensors is equally applicable to both forms of command signal.

An embodiment of the present invention will now be described by way of example with reference to the accompanying drawings, in which:

FIG. 1 illustrates part of the operator's control panel; and

Figure 2:
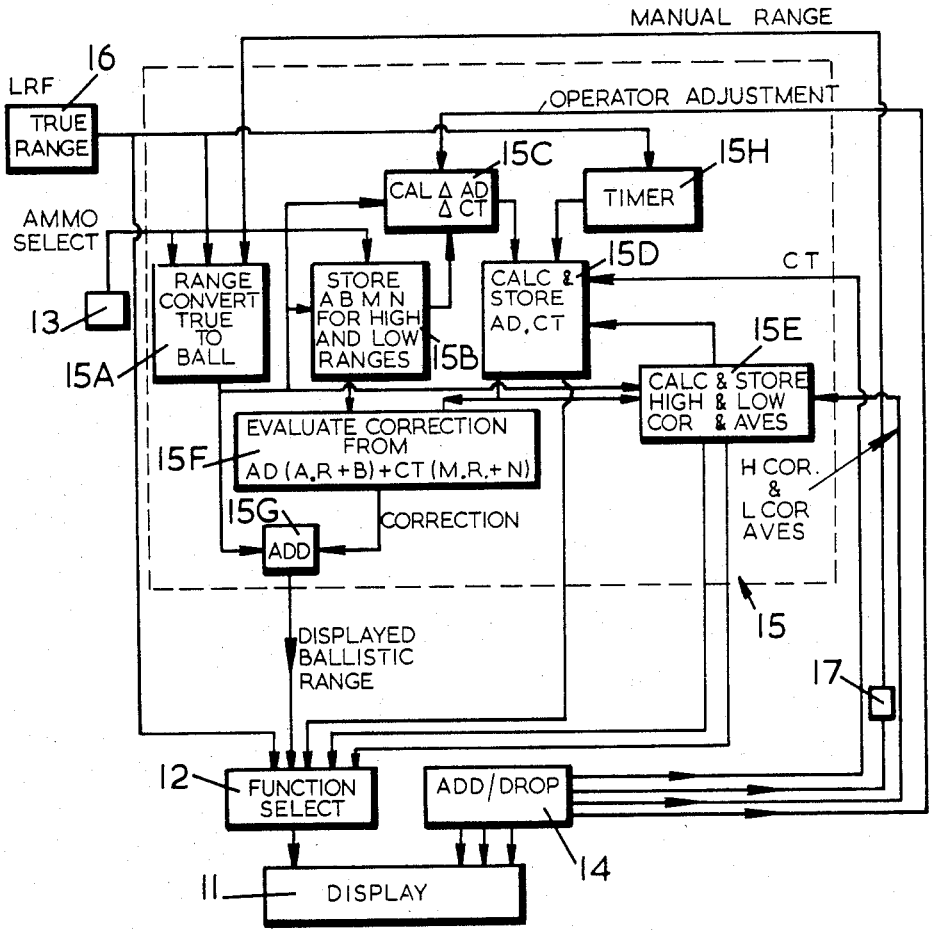

FIG. 2 schematically illustrates the computer.

The panel 10 shown in FIG. 1 comprises a digital display 11 with a function selector switch 12 which determines the function whose value is displayed. Switch 12 can select true range or ballistic range or manual range or charge temperature or high correction average or low correction average. A selector switch 13 is provided for identifying the type of ammunition in use, for example HE, HESH, COAX, 0.5, SMOKE as designated in FIG. 1 and digit adjustment buttons 14A and 14B are provided for the operator to enter manually an adjustment to the displayed function, buttons 14A being for incrementing and 14B for decrementing. The panel 10 is coupled to a local computer 15 which is also coupled to a laser rangefinder 16 and the operation of the system is such that the operator sets switch 13 to the selected ammunition type and this information is automatically entered into computer 15. With function switch 12 at 'ballistic range' he operates the rangefinder 16 which is mechanically linked to the gun sight and thereby produces a true range measurement to the target on which the gun sight is trained. This true range indication is directly entered into computer 15 which outputs a standard ballistic range value which is displayed at display 11. This standard ballistic range value is generated on a predetermined basis namely that, for the selected type of ammunition, and the particular graticule in the sight, all other parameters such as charge temperature, barrel wear, air density etc. are at standard values as a result of which the true to ballistic range conversion data is predetermined and is stored in the computer in table form. The operator then elevates the gun sight until the graticule mark with the same numerical value as the value displayed at 11 is superimposed on the target. The gun is then fired and in the event of the shot landing short of or overshooting the target the displayed value at 11 is adjusted by the operator making a judgement on the magnitude and direction of the miss relative to the target and entering that judgment in the display 11 via buttons 14A or 14B. The operator then adjusts the elevation of the gun sight until the new graticule value is superimposed on the target and then fires a second shot. This procedure is repeated until the shot scores a hit on the target whereafter the computer 15 updates its information content as will be explained so that for a new target the ballistic range value output by the computer to the display 11 will be computer-corrected and of sufficient accuracy to give a very high hit probability prior to the operator making a manual correction.

The computer 15 is of the microprocessor type and data is principally stored in table form so that a true range value is used as an input to produce the corresponding standard ballistic range output value previously described. Additionally range correction data is stored to permit evaluation of correction factors based upon the realisation that the principal parameters affecting ballistic range for a given gun and given ammunition type are charge temperature and air density.

We have established that a reasonable approximation to the correction factor for these parameters is given by the formulae:

$$AD\cdot(A\cdot R+B)+CT\cdot(M\cdot R+N)$$

where AD is air density on a scale where standard air density is zero; CT is charge temperature on a scale where standard charge temperature is zero; R is standard ballistic range; and A, B, M and N are coefficients which have first predetermined values for ranges (R) less than a predetermined range value and second predetermined values for ranges (R) equal to or greater than that predetermined range value. For example, the predetermined range value may be 1500 meters (true range). In this formulae the decimal point or dot denotes multiplication and this multiplication sign is used throughout the text The computer 15 is arranged to operate so that commencing from a standard ballistic range when the operator fires a first shot at a particular true range value and misses the target he assesses the manual range-adjustment required to achieve a hit on the target with a second shot, moves the gun to the adjusted ballistic range and fires. If this second shot scores a hit the operator takes no more action at that stage. The operator's action in effecting the manual range-adjustment or correction on the display 11 is automatically fed into the computer 15 which updates the correction data in a manner to be described so that the displayed ballistic range for all subsequent true range values will be of sufficient accuracy to provide a high probability of a hit with minimal need for adjustment by the operator.

This is achieved by the computer 15 operating so that in the initial encounter any adjustment required to the standard ballistic range is effected solely as an air density parameter correction. Thus, if the encounter is at a true range of 1000 meters and the first shot achieves a hit the air density parameter (AD) is maintained at zero for all subsequent engagements until the operator enters a further adjustment. If, however, the first encounter requires a second shot to achieve a hit the operator's adjustment is entered into computer 15 which evaluates the air density parameter (AD) and this evaluated air density parameter is maintained for all subsequent engagements until the operator enters a subsequent adjustment. This evaluation is effected from the equation:

$$\text{operator's adjustment}=AD\cdot(A\cdot R+B)$$

and all parameters except AD are known.

The foregoing discussion is based upon there being no change required to the charge temperature parameter (CT), and it will be appreciated that CT can be set initially either to zero or to a non-zero level but even in the latter event the air density parameter AD can still be evaluated since the factor CT·(M·R+N) is known.

It will now be understood that the result of the first engagement is to evaluate all variable parameters in the equation:

$$\text{displayed ballistic range}=\text{standard ballistic range}+AD\cdot(A\cdot R+B)+CT\cdot(M\cdot R+N).$$

In the event of a subsequent encounter leading to an operator's adjustment being entered into the computer 15 the system is arranged to operate so that both the AD and CT parameters are re-evaluated, in a manner to be explained, and the re-evaluated levels thereafter maintained for all ranges until the operator makes a subsequent adjustment. Suppose, by way of example, that the next adjustment is required at a true range value of 2000 meters it is then evident that the operator's adjustment $C_1$, for the range $R_1=2000$ meters is given by the equation:

$$C_1=\Delta AD(A\cdot R_1+B)+\Delta CT(M\cdot R_1+N)$$

where ΔAD is the change required to the parameter AD, and ΔCT is the change required to the parameter CT. To solve this equation the computer 15 is programmed to note that $R_1(=2000$ meters) is greater than the range 1500 meters and to then apply the equation:

$$C_o=O=\Delta AD(A'R_o+B')+\Delta CT(M'R_o+N')$$

where $R_o=500$ meters. That is, that the required correction $C_o$ at the 500 meter range (which is a predetermined range value) is zero. The computer 15 therefore has two equations with two unknowns, ΔAD and ΔCT, and these can therefore be evaluated by the computer using standard algebraic techniques so that the new values of AD and CT can be determined.

If any subsequent adjustment is required at a range less than 1500 meters a similar calculation is performed by the computer 15 using $C_o=0$ for $R_o=2500$ meters (which is a predetermined range value).

It will be appreciated that $AD_n=AD_{n-1}+\Delta AD$ and that $CT_n=CT_{n-1}\Delta CT$ where the subscript n−1 denotes the previous value and subscript n denotes the new value. In the foregoing description the previous values of $AD_{n-1}$ and $CT_{n-1}$ have been the previously computed values.

It will now be appreciated that in order to calculate ΔAD and ΔCT the computer 15 utilises and estimated correction $C_o$ at one of two predetermined range values, depending upon which is more remote from the particular true range value. In the previous discussion we have taken $C_o=0$ but we also evaluate corrections (COR) at the predetermined range values and in predetermined circumstances use the average of the previous three evaluations. That is when the true range is below 1500 meters we evaluate by the computer COR at 500 meters for each of the operator's adjustments, store these evaluations, and determine the average of the last three such evaluations (low correction average or LCOR). Likewise when the true range is 1500 meters or greater we evaluate by the computer COR at 2500 meters for each of the operator's adjustments, store these evaluations, and determine the average of the last three such evaluations (High correction average of HCOR). These evaluations and updating of HCOR and LCOR are effected automatically by the computer 15 from the information stored therein on receipt of each signal from rangefinder 16 and prior to the computer re-evaluating AD and CT in consequence of an operator's adjustment. Prior to three evaluations of HCOR and LCOR we can utilise the average of only two HCOR and LCOR evaluations or we can utilise HCOR and LCOR averages imported from another similar fire control system and it is for this reason that function selector switch 12 has 'high average' and 'low average' functions. That is, the HCOR average and the LCOR average can be read out from computer 15 and displayed at 11 for export to another similar fire control system and imported HCOR and LCOR averages can be dialled onto display 11 (using buttons 14) and entered into the computer 15 by setting selector switch 12 appropriately and actuating buttons 14.

These high and low range average values are retained in a protected store of the computer 15 and are utilised to calculate the initial values of AD and CT in a 'restart' mode which ensues automatically if the time elapsed between successive true range readings received by the computer exceeds a predetermined value (for example one hour). The true range value received (after one hour) enables the computer 15 to use the high and low range average values HCOR and LCOR to determine AD and CT. Also the 'restart' mode ensues automatically if the true range value received does not lie in the same low or high range interval as the preceding true range value.

FIG. 2 schematically illustrates the format of the computer 15 in greater detail and additionally shows the connections of components 11, 12, 13, 14, 16 and 17 thereto. Computer 15 comprises memory 15A storing values of standard ballistic range which are accessed by values of true range as determined by rangefinder 16; memory 15B stores values of the coefficients A, B, M, and N for both high range and low range, memories 15A and 15B (which although illustrated separately may be physically integral) storing the appropriate values for each of the different types of ammunition and the appropriate set of such values being accessed by means of switch 13. Block 15C is an arithmetic unit organised to calculate ΔAD and ΔCT as previously described and block 15D calculates the parameters AD and CT as previously described, preferably using the high and low average values of HCOR and LCOR as calculated and stored by block 15E. Block 15F is an arithmetic unit which evaluates the correction factor using the formula $$AD\cdot(A\cdot R+B)+CT\cdot CM\cdot R+N)$$

and this is added by adder 15G to the standard ballistic range value R and fed via the selector switch 12 to the display 11. The adjustments input by the operator are effected by block 14, via display 11 and routed according to selector switch 12 to block 15C. Manual entries of HCOR average and LCOR average are effected according to the position of selector switch 12 respectively to block 15E and manual range is entered to memory 15A on pressing the enter button 17, and charge temperature CT to block 15D. The 'restart' mode is detected by timer 15H which on elapse of predetermined time interval from receipt of a range value from the rangefinder controls block 15D to erase the stored values of AD and CT and to calculate new values of AD and CT using the high and low averages from block 15E.

In the foregoing description we have referred to an operator and we wish it to be understood that this term may embrace more than one individual person such as is the case when the fire control system is incorporated in a tank where some of the operator's duties are undertaken by a gunner and other duties are undertaken by a commander.

What is claimed is:

1. A gun fire control system comprising means for presenting a command signal representing a range value to a system operator, manually-operable means for providing a range correction input by a system operator as a measure of the extent by which a projectile misses a target sighted according to the command signal, a rangefinder for establishing a true range value to the target, first memory means preprogrammed with true range to standard ballistic range conversion data and responsive to receipt of a true range value to output the corresponding standard ballistic range value from said conversion data, second memory means preprogrammed with preset correction coefficients, first calculating means for evaluating air density and charge temperature parameters according to the outputs of said manually-operable means, said first memory means and said second memory means, second calculating means for evaluating a correction factor utilising the parameter values evaluated by said first calculating means, the standard ballistic range value output by said first memory means and the correction coefficients from said second memory means, combining means for combining the standard ballistic range value output by said first memory means and the correction factor output by said second calculating means to provide a corrected ballistic range value for delivery to said presenting means and against which to sight the target for firing a subsequent projectile.

2. A fire control system as claimed in claim 1, wherein said second memory means is preprogrammed with sets of correction coefficients respectively pertaining to different projectile types, the output set being identified by a manually-operable selector switch.

3. A fire control system as claimed in claim 2, wherein each set of correction coefficients comprises a plurality of subsets respectively pertaining to ballistic range values within a plurality of range intervals, the output subset being identified by the ballistic range value output by said first memory means.

4. A fire control system as claimed in claim 1, wherein said second calculating means evaluates said correction factor (COR) according to the algorithm $$COR = AD \cdot (A \cdot R + B) + CT \cdot (M \cdot R + N)$$

where

AD = air density parameter value

CT = charge temperature parameter value

A,B,M,N = preset correction coefficients

R = standard ballistic range.

5. A fire control system as claimed in claim 4, wherein said first calculating means evaluates said parameters according to the said algorithm by first identifying the range interval encompassing the standard ballistic range for a given target and then identifying a predetermined range value in a different range interval at which the correction factor is preset so as to establish a first equation with two unknowns, a second equation with two unknowns being established by the operator-applied correction at the identified standard ballistic range, said two equations being solved to evaluate said two parameter values.

6. A fire control system as claimed in claim 5, wherein the two unknowns evaluated by said two equations are parameter correction values and these are combined with the previous parameter values which are stored in up-dated form.

7. A fire control system as claimed in claim 6, wherein said preset correction factor is computed as the average of a plurality of correction factor evaluations according to said algorithm at the predetermined range value within the range interval encompassing the standard ballistic range for a plurality of targets, such evaluations being undertaken subsequent to evaluation of the updated parameter values pertaining to the respective targets.

* * * * *